United States Patent [19]

Laval, Jr.

[11] 3,963,073

[45] June 15, 1976

[54] PURGING APPARATUS

[76] Inventor: Claude C. Laval, Jr., 2444 Farris Ave., Fresno, Calif. 93705

[22] Filed: June 25, 1975

[21] Appl. No.: 590,036

Related U.S. Application Data

[62] Division of Ser. No. 396,522, Sept. 12, 1973, abandoned.

[52] U.S. Cl. ..... 166/105.1; 222/193; 302/15

[51] Int. Cl.[2] ..... E21B 43/00

[58] Field of Search ..... 166/105–105.4; 37/62, 63; 222/193; 239/143, 310; 302/14–16, 45–47, 52–54, 66

[56] References Cited

UNITED STATES PATENTS

| | | | |
|---|---|---|---|
| 1,601,921 | 10/1926 | McCoy | 166/105.1 |
| 1,672,687 | 6/1928 | Penrod et al. | 166/105.4 |
| 1,719,668 | 7/1929 | McEachern | 37/63 |
| 2,170,881 | 8/1939 | Werts | 166/105.1 |
| 2,271,002 | 1/1942 | Fosnaugh | 166/105.1 |
| 2,870,565 | 1/1959 | Martin | 222/193 |
| 3,289,608 | 12/1966 | Laval, Jr. | 166/105.1 |
| 3,362,405 | 1/1968 | Hazel | 222/193 X |

*Primary Examiner*—James A. Leppink
*Attorney, Agent, or Firm*—Huebner & Worrel

[57] ABSTRACT

A purging apparatus having a housing for receiving material subsequently to be purged, a source of fluid under pressure connected to the housing adapted to direct a fluid stream into the housing to agitate the material therein, a tube mounted on the housing and having a vortex chamber communicating with the housing through a slot disposed transversely and eccentrically to the chamber, and a discharge conduit connected to the tube.

20 Claims, 9 Drawing Figures

PURGING APPARATUS

CROSS REFERENCE TO RELATED APPLICATION

This application is a division of the applicant's copending parent patent application, Ser. No. 396,522, filed Sept. 12, 1973 now abandoned, entitled "Purging Apparatus".

BACKGROUND OF THE INVENTION

The present invention relates to a purging apparatus and more particularly to such an apparatus which is adapted in a variety of operative environments to remove viscous fluid or particulate matter from a predefined remote area and transmit such matter to a more accessible location for collection or disposal, such as in the case of sand collected by a separator attached to a fluid pump submerged in a water well.

There are a variety of operative environments in which it is desirable to transfer particulate matter from a remote location of difficult access to a more accessible area. One such environment exists where pumps are employed at depth in water wells. As disclosed by the applicant's U.S. Pat. No. 3,289,608, a seperating device, or separator, is mounted on the intake end of such a pump for the removal of sand, silt, clay, and other water borne foreign particles prior to introduction of the water into the pump so as to minimize the likelihood of damage or inordinate wear being caused to the pump by such foreign particles. The particles removed by the seperator are thereafter transmitted through conduits to the discharge end of the pump so as to circumvent the pump itself. Separators have proven to be of vital importance in minimizing submersible pump wear and avoiding the necessity of pulling the pump from the well for the replacement of worn parts at intervals approaching prohibitive frequency. However, the venturi tubes and other structure heretofore required to initiate and continue such pump by-pass produce an undesirable pressure drop.

Dredging operations present another environment in which the removal of particulate matter from areas is required. The continual influx of sand, silt, clay, and the like to canals, rivers, lakes, and harbors requires that the beds of such bodies of water periodically be dredged for the removal of these materials. Unless dredging is performed, such bodies of water become unusable and frequently contribute to flood danger. Prior art procedures call for the use of one of a variety of cumbersome implements to scoop such material from the bed of the body of water for deposit on the bank of the body of water of disposal. However, the cumbersome movement of such implements during dredging creates disruptive turbulence and agitates much of the material into fluid suspension thus polluting and otherwise damaging the area. The pollution destroys fish and plant life and may be hazardous to human health where such bodies of water are drawn from as sources of public drinking water. In aggravated situations, the resultant pollution may cause virtually irreparable harm.

Therefore, it has long been recognized that it would be desirable to have a purging apparatus which could be employed rapidly and efficiently to remove particulate matter from a confined remote area and transport such material to a more accessible location without the use of operative elements which would be subject to rapid wear.

SUMMARY OF THE INVENTION

In view of the foregoing, it is an object of the present invention to provide an improved purging apparatus.

Another object is to provide an apparatus which is adapted to remove particulate matter from a remote confined area and transmit such matter to an area of ready access.

Another object is to provide such an apparatus which is adapted for use in a wide variety of operative environments.

Another object is to provide such an apparatus which is constructed so as to preclude the necessity of mounting a pump in or adjacent to the area to be purged.

Another object is to provide such an apparatus which is constructed so as to minimize wear to the operative parts thereof.

Another object is to provide such an apparatus which employs a fluid to agitate particulate matter into fluid suspension for removal from the remote area.

Another object is to provide such an apparatus which is particularly suited to be mounted on a separator and submersible pump positioned at depth in a water well.

Another object is to provide such an apparatus which can be operated at relatively infrequent intervals to remove particulate matter collected from a separator in a rapid flushing action.

Another object is to provide such an apparatus which is adapted for use in dredging operations.

Another object is to provide such an apparatus which can be employed to remove sand, silt, clay, and other foreign particles from the bed of a canal, river, harbor, or the like with a minimum of disturbance to plant and wild life and without polluting the body of water.

Another object is to provide such an apparatus which utilizes pressure rather than suction to remove matter to maximize the volume of such matter capable of being removed.

A further object is to provide such an apparatus which can be constructed in a relatively small size and minimum weight for ease of handling.

Further objects and advantages are to provide improved elements and arrangements thereof in an apparatus for the purposes described which is dependable, economical, durable and fully effective in accomplishing its intended purposes.

DESCRIPTION OF THE FIRST EMBODIMENT

Figure 1:
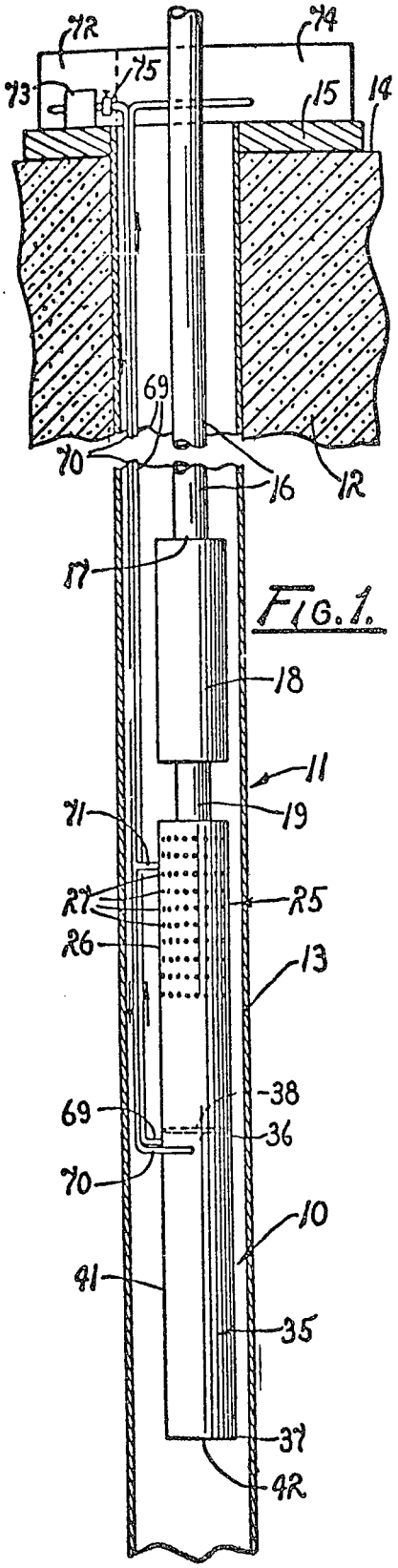
FIG. 1 is a fragmentary vertical section of the purging apparatus of the first form of the present invention mounted in a representative operative environment on a separator within a water well.

Referring more particularly to the drawings, the purging apparatus of the first form of the present invention is generally indicated by the numeral 10 in FIG. 1. As shown therein, the apparatus is mounted in a water well, generally indicated by the numeral 11, within the earth 12. The well has an elongated well casing 13 extending vertically into the earth from the earth surface 14. A foundation 15 is extended about the casing on the earth surface. A water removal conduit 16, having a remote end 17, extends down the well casing in the conventional manner with the remote end positioned at a preselected depth below the earth surface. A fluid pump 18 is secured on the remote end of the water conduit within the well casing. The fluid pump has an inlet conduit 19 affixed on the end thereof opposite that connected to the remote end of the water conduit.

A particulate matter separator 25, such as that disclosed in the applicant's aforementioned patent, is mounted on the inlet conduit 19 of the fluid pump 18, as best shown in FIG. 1. The separator has a side wall 26 having a plurality of circumferentially spaced rows of orifices or inlets 27 extending longitudinally thereof.

Figure 2:
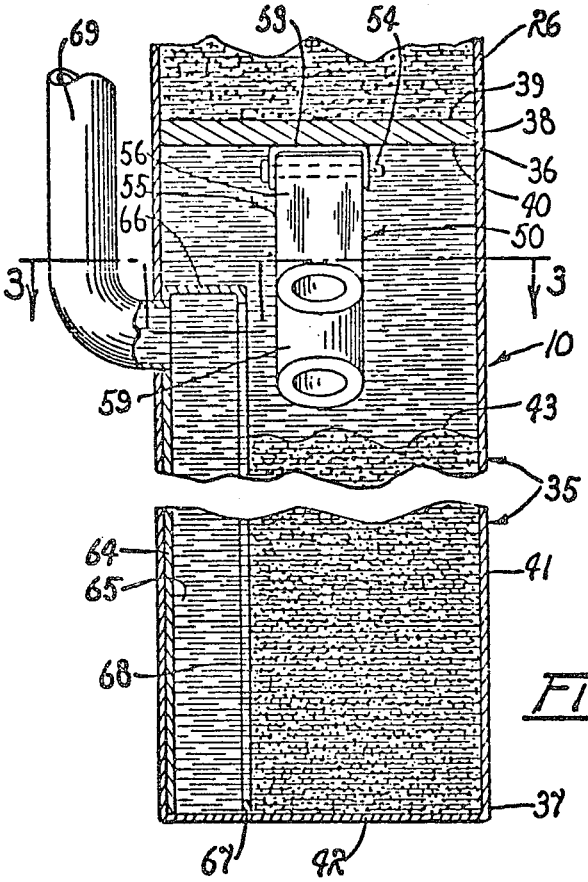
FIG. 2 is a somewhat enlarged fragmentary vertical section of the apparatus.

The purging apparatus 10 has a particle collection housing 35 integrally mounted on the separator 25 at the end thereof opposite to that in connection with the inlet conduit 19 and in axial alignment with the separator. The housing has an upper end 36 integral with the separator and an opposite lower end 37. The separator and collection housing have a common wall 38 extending therebetween with an upper surface 39 and a lower surface 40. It will become apparent that the housing can be manufactured and sold as a separate unit for attachment to existing separators. It is shown and described herein as an integral part of the separator for illustrative convenience. The housing has a substantially cylindrical side wall 41 which extends in fluid tight relation about the wall 38, as best shown in FIG. 2. The housing has a particle receiving floor or bottom wall 42 mounted in fluid tight relation on the side wall at the lower end of the housing. As shown in FIG. 2, the collection housing is adapted to receive particulate matter 43 therein.

Figure 4:
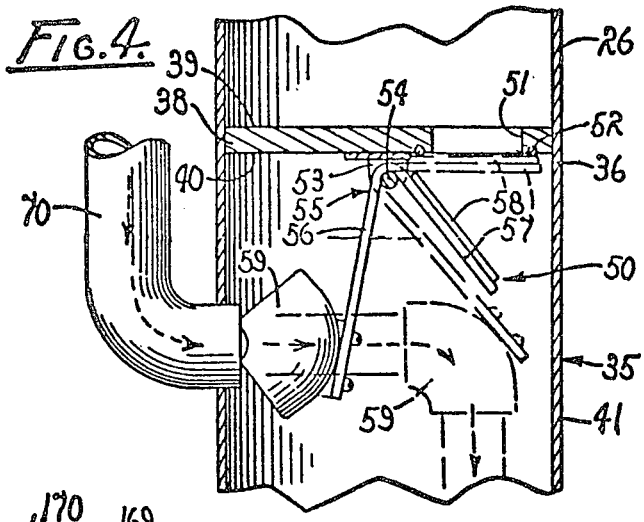
FIG. 4 is a fragmentary vertical section taken from a position indicated by line 4—4 in FIG. 3.

A valve is mounted on the lower surface 40 of the wall 38, as best shown in FIGS. 2 and 4. The valve has a particle receiving passage, or valve opening 51 extending through the wall adjacent to the side of wall 41 of the collection housing 35. An O-ring 52 is affixed on the lower surface 40 of the wall 38 extending concentrically about the valve opening. The valve has a bracket 53 which is fastened on the lower surface and mounts a pivotal connection 54 substantially centrally of the wall. A return-bent valve closure 55, consisting of a pressure plate 56 and integral sealing plate 57, is pivotally mounted on the connection 54 so as gravitationally to extend below the wall. A seal 58 is fastened on the sealing plate in a predetermined position so as to be engageable with the O-ring 52 in fluid sealing relation. A right angle elbow conduits or baffle 59 is borne by the pressure plate in a predetermined position, as shown in FIG. 4.

Figure 3:
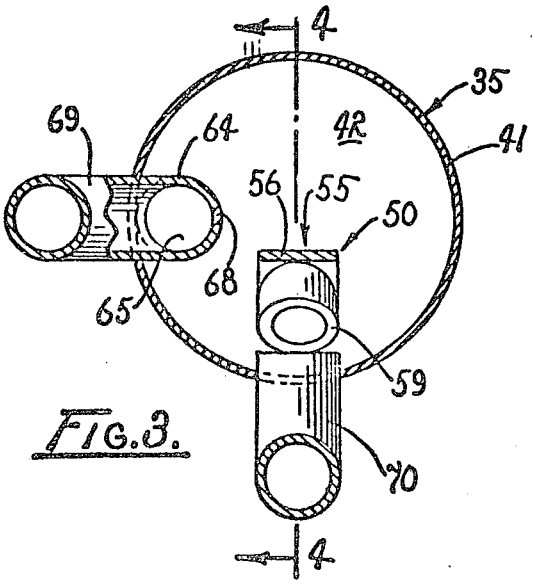
FIG. 3 is a horizontal section taken from a position indicated by line 3—3 in FIG. 2.

A vortex tube 64, having an internal vortex chamber 65, is mounted within the particle collection housing 35 on the side wall 41 extending longitudinally thereof. The tube has a sealed upper end 66 and a lower end 67 is sealed engagement with the bottom wall 42 of the houusing. The tube has a longitudinal slot 68 extending from a position adjacent to the upper end thereof to a position adjacent to the lower end. The slot communicates with the vortex chamber at a tangential or oblique angle, as shown in FIG. 3. The slot is preferably very slightly tapered from the position adjacent to the upper end to the lower end of the tube, for purposes subsequently to be described. A discharge conduit 69 extends through the vortex tube and side wall 41 of the housing 35 at a position adjacent to the sealed upper end of the tube. The conduit extends from the particle collection housing upwardly through the well casing 13 and outwardly therefrom above the earth surface 14. An inlet conduit 70 is extended from a predetermined position above the earth surface downwardly through the well casing. The inlet conduit is extended through the side wall 41 of the housing to a position in alignment with the baffle 59 borne by the valve closure 55, as best shown in FIG. 4. A pressure counterbalance conduit 71 extends in fluid transferring relation from the inlet conduit to the separator 25 in communication with the interior thereof, for purposes subsequently to be described.

A fluid filter 72 is mounted on the foundation 15 and the inlet conduit 70 is operatively connected thereto. The fluid filter is adapted to filter particulate matter from water transmitted therethrough. A fluid pump 73 is secured on the inlet conduit on the downstream side of the filter. A fluid reservoir 74 is mounted on the foundation in fluid transferring relation to the fluid filter. The discharge conduit 69 is mounted at its upper end in communication with the fluid reservoir. A control valve 75 is operably mounted on the inlet conduit between the filter and pump. It will be readily apparent that the discharge conduit need not be connected to the reservoir so as to establish a closed system. Thus, the conduit could be mounted to discharge its contents without removing the fluid therefrom for reuse. However, the above-described configuration is believed preferable for reasons of efficiency, economy, and ecology.

Figure 5:
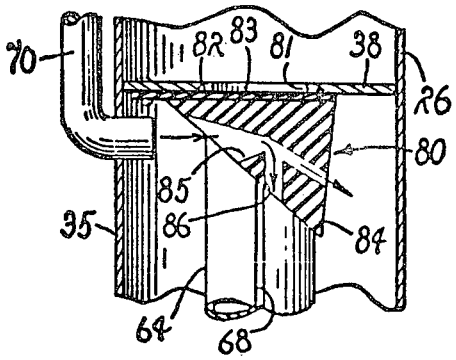
FIG. 5 is a fragmentary vertical section of the apparatus showing a second from of valve for the invention.

Valve 50 shown in FIGS. 2 through 4 is believed to embody the most operably effective construction. However, numerous other forms of valves can be employed without departing from the scope of the present invention. A second form of valve for the purging apparatus 10 is shown in FIG. 5 generally indicated by the numeral 80. The valve 80 has a valve opening or passage 81 located centrally of the wall 38 and an O-ring 82 mounted concentrically thereabout. A sealing flap 83 is affixed on the lower surface 40 of the wall so as to be positionable in sealing relation to the valve opening. A weight member 84 is secured on the flap gravitationally to retain the flap out of engagement with the O-ring when the purging apparatus 10 is not in use. The weight member has a funnel shaped passage 85 extending therethrough. A deflection passage 86 extends into the weight member in communication with the funnel shaped passage, as shown in FIG. 5. The sealing flap and weight member are constructed so that the entrance to the funnel shaped passage is positioned in facing relation to the inlet conduit 70.

Figure 6:
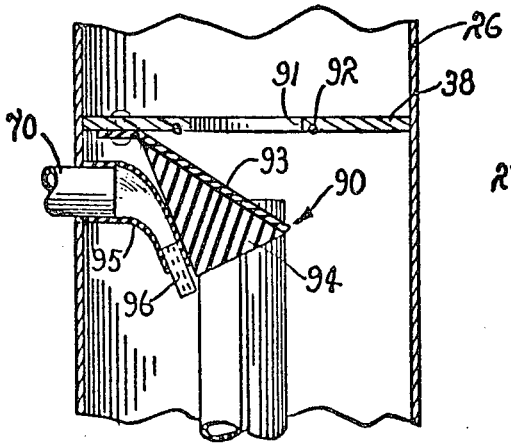
FIG. 6 is a fragmentary vertical section of the apparatus showing a third form of valve for the apparatus.

A third form of valve is generally indicated by the numeral 90 and is shown in FIG. 6. The valve has a valve opening or passage 91 located centrally of the wall 38. An O-ring 92 is mounted on the lower surface 40 of the wall concentrically about the valve opening. A sealing flap 93 is affixed on the lower surface of the wall 38 so as to be engageable in fluid sealing relation with the O-ring. A weight member 94 is borne by the sealing flap and adapted to maintain the valve in the open attitude shown in FIG. 6. A tapered resilient valve finger 95 is mounted on the inlet conduit 70 within the collection housing 35 and has a nozzle 96 at the inwardmost end thereof. The valve finger is preferably of a resiliency causing it to engage the weight member, as shown in FIG. 6, when the purging apparatus 10 is not in use.

DESCRIPTION OF THE SECOND EMBODIMENT

Figure 8:
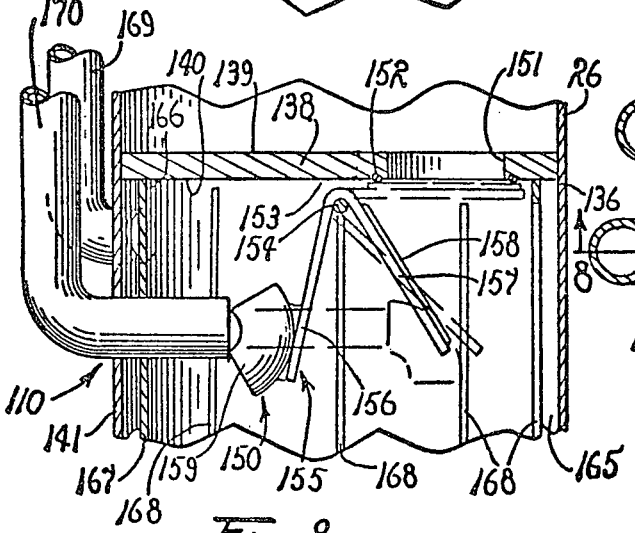
FIG. 8 is a fragmentary vertical section taken from a position indicated by line 8—8 in FIG. 7.
Figure 7:
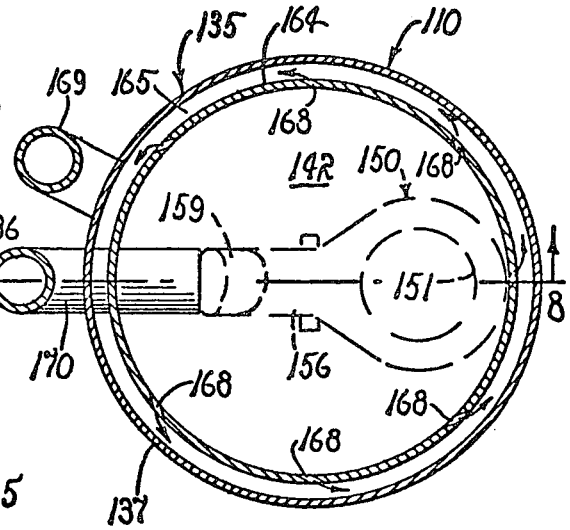
FIG. 7 is a horizontal section of the purging apparatus of the second form of the present invention.

The purging apparatus of the second form of the invention is shown in FIGS. 7 and 8 generally indicated by the numeral 110. As in the first form of the invention, the purging apparatus 110 is assembled as shown in FIG. 1 in relation to the separator 25 and adapted selectively to remove particulate matter deposited therein by the separator. The structure of the second form of the invention differs from that of the first primarily in the construction of the particle collection housing 135. The collection housing has an upper end 136 mounted in axial alignment with the separator 25 and a lower end 137. The separator and collection housing have a common wall 138 extending therebetween having an upper surface 139 and a lower surface 140. The housing has a cylindrical side wall 141 which is integral with the side wall 26 of the separator extending in fluid tight relation about the wall 138, as best shown in FIG. 8. A bottom wall 142 is secured in fluid tight relation on the side wall at the lower end of the collection housing.

The second form of purging apparatus 110 has a valve 150 having substantially the same structure as the valve 50 of the purging apparatus 10. The valve has a passage or valve opening 151 located in a predetermined position in the wall 138, as best shown in dashed lines in FIG. 7. An O-ring 152 is mounted on the lower surface 40 of the wall 138 concentrically about the valve opening 151. The valve 150 has a bracket 153 mounted in approximately spaced relation to the center of wall 138. A pivotal connection 154 is borne by the bracket and mounts a return-bent valve closure 155 thereon. The valve closure has a pressure plate 156 and sealing plate 157 and is adapted for pivotal movement to and from engagement of the sealing plate with the O-ring 152, as best shown in FIG. 8. As in the first form of the invention, a seal 158 is fastened on the sealing plate and a right angle elbow conduit 159 is affixed on the pressure plate.

The purging apparatus 110 has a comparatively large diameter vortex tube 164 mounted within the collection housing 135 inwardly concentric to the common wall 138 thereof. The tube is spaced a predetermined, relatively short distance from the side wall so as to define a vortex chamber 165 extending concentrically about the tube, as best shown in FIG. 7. The vortex tube has an upper end 166 and a lower end 167 which individually engage the wall 138 and the bottom wall 142 respectively in fluid tight relation. The tube has a plurality of slots 168 extending longitudinally thereof between the upper and lower ends in circumferentially spaced relation, as best shown in FIG. 8. As in the first form of the invention, the slots are slightly tapered from the upper end to the lower end of the tube. A discharge conduit 169 extends through the side wall 141 of the collection housing 135 in fluid tight communication with the concentric vortex chamber 165. An inlet conduit 170 extends through the side wall 141 of the housing and the vortex tube 164 in alignment with the valve closure 155 of the valve 150, as best shown in FIG. 7.

As in the first form of the invention shown in FIG. 1, the discharge and inlet conduits 169 and 170 respectively are operable connected to a suitable fluid system mounted on the foundation 15 consisting of a fluid reservoir, fluid filter, control valve, and fluid pump. Furthermore, a pressure release conduit preferably interconnects the inlet conduit and the separator 25, as described in regard to the first form of the invention. This structure is not shown in the drawings or otherwise described herein in order to avoid repetitious discussion.

DESCRIPTION OF THE THIRD EMBODIMENT

Figure 9:
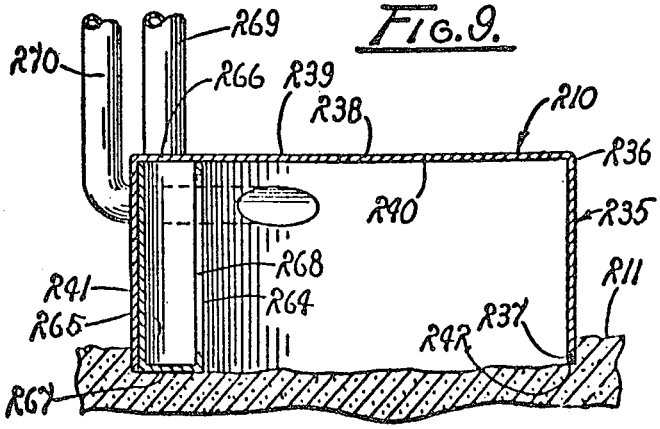
FIG. 9 is a vertical section of the purging apparatus of the third form of the present invention.

The purging apparatus of the third form of the present invention is shown in FIG. 9 and generally indicated by the numeral 210. In distinction from the purging apparatus 10 and 110, the purging apparatus 210 is primarily designed for use in the performance of dredging operations. As shown in FIG. 9, the apparatus is positioned in engagement with the bed 211 of a body of water such as a canal, river, harbor, or the like.

The purging apparatus 210 has a particle housing 235 having an upper end 236 and a lower end 237. The housing has a top wall 238, having an upper surface 239 and a lower surface 240. The housing also has a side wall 241 which is affixed on the top wall in fluid tight relation. The side wall defines an opening 242 at the lower end of the housing.

A vortex tube 264, having an internal vortex chamber, is mounted within the particle housing 240 in engagement with the side wall 241 thereof. The tube engages the top wall 238 so as to form a sealed upper end 266. The tube has a sealed lower end 267. As in the first form of the invention, the tube has a longitudinal slot 268 extending in gradually tapering relation from the upper end to the lower end thereof. A discharge conduit 269 is mounted on the particle housing 235 extending through the sealed upper end of the tube to communicate with the vortex chamber. An inlet conduit 270 extends through the side wall 241 of the particle housing in oblique relation. The inlet conduit communicates at its remote end with a suitable source of fluid under pressure, not shown. The discharge conduit communicates at its remote end with suitable apparatus, not shown, for collecting or disposing of the particulate matter collected by the apparatus.

OPPERATION

The operation of the described embodiments of the subject invention is believed to be clearly apparent and is briefly summarized at this point. As previously discussed, the purging apparatus 10 of the first form of the present invention is specifically adapted for use mounted on the separator 25 of a fluid pump 18 as shown in FIG. 1. As disclosed in the applicant's U.S. Pat. No. 3,289,608, during normal operation of the fluid pump the separator 25 operates to remove particulate matter from the water prior to introduction to the pump. The separated matter is gravitationally deposited on the upper surface 39 of the wall 38 during such operation.

The purging apparatus 10 can be operated simultaneously with the pump 18 and separator 25. However, when the apparatus is not in operation, the valve closure 55 is gravitationally retained in the position shown in full lines in FIG. 4 with the seal 58 retained away from engagement with the O-ring 52. Therefore, particulate matter gravitationally enters the particle collection housing 35 through the valve opening 51. In actual operation, the particulate matter collects on the upper surface 39 of the wall 38 in a funnel-like configuration which assists in directing particulate matter to the valve opening.

When significant quantity of particulate matter 43 has been collected in the collection housing 35, as shown in FIG. 2, operation of the fluid pump 18 and separator 25 can be terminated or left operating during use of the purging apparatus 10. The valve 75 and fluid pump 73 are operated to pump water from the reservoir 74 through the fluid filter 72 down the inlet conduit 70 and into the collection housing 35, as best shown in FIG. 4. The water is rapidly discharged against the elbow conduit 59 so as to rotate the valve closure 55 to the position shown in dashed lines in FIG. 4. Thus, the seal 58 engages the O-ring 52 in fluid sealing relation thereby sealing the housing from the separator. Where the pump and separator are allowed to continue to operate, the particulate matter simply collects on the upper surface 39 of the common wall 38.

The pressure plate 56 of the valve closure 55 is simultaneously positioned as shown in dashed lines in FIG. 4. Consequently, a substantial volume of water discharged into the collection housing 35 is directed through the elbow conduit 59 and diverted downwardly therein, as shown in FIG. 4. Thus, the valve 50 is retained in a closed position while water is discharged in agitating relation against the particulate matter collected within the housing. Such a discharge of water within the housing serves the dual function of pressurizing the collection housing with water while agitating the matter into fluid suspension. The only means of escape for the water from the collection housing is through the longitudinal slot 68 of the vortex tube 64. The water borne matter is thus discharged into the vortex chamber through the longitudinal slot. Since the water makes an oblique entry to the chamber through the slot, as best shown in FIG. 3, and the movement of water through the collection housing is quite rapid, the water is rapidly circulated in a vortex within the chamber. Furthermore, the signifcantly smaller diameter of the vortex chamber in comparison with that of the collection housing assists in rapidly increasing the velocity of flow during movement from the housing into the chamber. These factors act to maintain the matter in fluid suspension during discharge of the water from the chamber upwardly through the discharge conduit 69 and out of the well casing 13 into the fluid reservoir 74.

The length of time required to purge all of the particulate matter 43 from the interior of the collection housing 35 is dependent upon the quantity of such material which has collected in the housing. However, experience has shown that this purging operation is performed quite rapidly. The rapid discharge of water is particle agitating relation to the material within the housing rapidly eats away in a downward direction at the quantity of material retained therein. As previously noted, the longitudinal slot 68 of the vortex tube 64 is tapered downwardly. This performs the function of facilitating entry of the fluid borne particles to the vortex chamber as the supply of particulate matter is depleted taking the upper surface of the supply farther from the jet of water being directed thereagainst by the elbow conduit 59.

When the particulate matter 43 has been purged, the pump 73 is shut off and the valve 75 closed to terminate the flow of water through the purging apparatus. The water standing in the inlet conduit above the pressure counterbalance conduit 71 at this time is gravitationally discharged through the counterbalance conduit and into the separator. This tends to equalize water pressure on opposite sides of the valve closure 55 so as again to allow the valve to open gravitationally.

Although valve 50 constitutes the preferred form of valve for the purging apparatus 10, valve 80 shown in FIG. 5 is also reliably operable. Valve 80 operates substantially as described in regard to the first form of valve. When water is discharged from the inlet conduit 70 into the interior of the collection housing 35, it enters the funnel shaped passage 85 to cause the weight member 84 to position the sealing flap 83 in sealing engagement with the O-ring 82. The sealing flap thus closes the valve in fluid sealing relation. A portion of the water discharged through the funnel shaped passage is diverted through the deflection passage 86 and directed against the supply of particulate matter 43 within the housing in particle agitating relation. Thus, the particulate matter is agitated into fluid suspension as previously described. When the purging apparatus is not in use and after the counterbalancing of water pressure by the pressure release conduit 71, the weight member 84 gravitationally retains the sealing flap 83 out of engagement with the O-ring 82 so as to allow the introduction of particulate matter through the valve opening into the interior of the collection housing.

Valve 90, shown in FIG. 6, also constitutes a quite practical and operable form of valve for the apparatus 10. As in the second form of valve 80, the weight member 94 gravitationally retains the sealing flap 93 away from the valve opening 91 when the purging apparatus is not in use. Thus, particulate matter 43 gains admission to the interior of the collection housing 35 through the valve opening 91. When the purging apparatus is operated to discharge water under pressure from the inlet conduit 70, the fluid pressure causes the valve finger 95 to be extended in substantial axial alignment with the flow of water from the conduit. The back pressure within the finger caused by the nozzle 96 retains the valve finger in the extended position while simultaneously causing the water to be discharged from the nozzle in a jet. The elevation of the valve finger lifts the weight member 94 so that the sealing flap 93 is placed in sealing engagement with the O-ring 92 so as to close the valve. The jet of water discharged from the nozzle agitates the particulate matter 43 into fluid suspension, as previously described.

The second form of purging apparatus 110 is shown in FIGS. 7 and 8. This form of purging apparatus is also intended to be mounted, as previously described in regard to purging apparatus 10, on the lower end of the separator 25 for collection of the particulate matter separated thereby. When operation of the purging apparatus is initiated, water under pressure is discharged from the inlet conduit 170 against the elbow conduit 159 to position the seal 158 in sealing engagement with the O-ring 152 thereby sealing the valve opening 151 and allowing pressurization of the interior of the collection housing 135. A substantial portion of the water is diverted by the elbow conduit into particle agitating relation to the material within the housing. Therefore, as the material is rapidly agitated into fluid suspension it is discharged from the center portion of the collection housing through the plurality of longitudinal slots 168, as best shown in FIG. 7. The significantly smaller interior area of the vortex chamber 165 and the oblique angle of entry for the water through the longitudinal slots causes the water borne particulate matter to be rapidly accelerated in a vortexing action about the vortex tube 164. As in the first form of purging apparatus, this action retains the particulate matter in fluid suspension during its transfer from the collection housing into and upwardly through the discharge conduit 169.

The third form of purging apparatus 210 is shown in FIG. 9. Unlike the forms of the invention previously described, this form of the invention is primarily adapted for operation in the dredging of particulate matter from the bed 211 of a body of water such as a canal, river, harbor, or the like. However, this form of purging apparatus operates in substantially the same manner as that previously described in regard to the first and second forms of the invention. The opening 242 of the particle housing 235 is positioned in engagement with the bed 211 in confining relation to particulate matter which is to be removed therefrom. Thereafter, water under pressure is discharged through the inlet conduit 270 and into the interior of the particle housing 235 in agitating relation to the particulate matter. Thus, the matter is agitated into fluid suspension and discharged from the interior of the housing through the longitudinal slot 268 of the vortex tube 264. As in the other forms of the invention, this causes the fluid borne matter to be rapidly vortexed within the vortex chamber 265 so as to retain the matter in suspension during transfer from the vortex tube and upwardly through the discharge conduit 269 to the surface for subsequent disposal.

It will be noted that the purging apparatus 210 can be employed rapidly and efficiently to remove such matter from the bed of a body of water. Since the fluid agitation is confined within the particle housing 235 during operation of the apparatus, the plant and wild life in the adjacent area is only minimally distrubed. Such minimal disturbance is caused during positioning of the housing and is not sufficient to constitute a hazard. Furthermore, this operation is performed quite rapidly, at minimum expense, and without the use of moving parts which rapidly become worn or jammed by particulate matter in the case of conventional dredging equipment.

Therefore, the purging apparatus of the present invention, in the various form disclosed herein, is adapted rapidly, efficiently, and comparatively inexpensively to remove particulate matter from a remote area of difficult access and to transmit such matter to a selected area of ready access for collection and/or disposal without the use of moving parts and other operative elements subject to inordinately rapid wear.

Although the invention has been herein shown and described in what are conceived to be the most practical and preferred embodiments, it is recognized that departures may be made therefrom within the scope of the invention, which is not to be limited to the illustrative details disclosed.

Having described my invention, what I claim as new and desire to secure by Letters Patent is:

1. In combination with a pump having a fluid intake adapted for insertion in a well, said pump mounting a particle separating device on the intake thereof, a purging apparatus comprising a particle collection housing mounted on the separating device having a particle receiving opening communicating with the separating device; means mounted on the housing for selectively opening and closing said opening; a source of fluid under pressure connected to the housing; a vortex tube mounted on the housing and having a slot therein communicating with the collection housing, said slot defining a path of fluid travel oblique to the tube; and a discharge conduit secured on the tube.

2. The combination of claim 1 in which the sealing means includes a valve closure mounted on the housing for movement between the source and the opening.

3. The combination of claim 2 in which a baffle is borne by the valve closure in fluid deflecting relation to the source of fluid.

4. The combination of claim 3 in which the housing has a substantially cylindrical interior and a particle receiving floor and the slot of the tube extends in progressively widening relation from a position adjacent to the separating device to a position adjacent to the floor.

5. The combination of claim 4 in which the discharge conduit has a remote end mounted on a fluid reservoir in fluid transferring relation.

6. The combination of claim 5 in which the source of fluid under pressure includes a fluid filter, a fluid pump and an inlet conduit interconnecting in series the reservoir, fluid filter, fluid pump, and interior of the particle receiving housing in alignment with the baffle.

7. The combination of claim 6 in which a pressure counterbalance conduit interconnects the inlet conduit and the separating device.

8. In combination with a submersible water pump, having water entrance and discharge ends, adapted for insertion in a water well, and mounting a particle separating device on the entrance end thereof, a particle purging apparatus comprising a collection housing, having an interior and a lower floor, secured on the separating device; a wall, having a valve opening therein, affixed on the housing so as to separate the separating device from the interior of the housing; a valve closure pivotally fastened on the wall adjacent to the valve opening within the interior of the housing; a valve opening sealing member borne by the closure; a water deflecting baffle secured on the closure; a water inlet conduit mounted on the housing and communicating with the interior thereof in alignment with the baffle; a tube, having a vortex chamber, affixed on the housing extending longitudinally with the interior thereof, said tube having a longitudinal slot therein obliquely communicating with the chamber; a water discharge conduit mounted on the housing in communication with the vortex chamber; and a selectively operable source of water under pressure mounted on the inlet conduit.

9. In combination with a pump having an intake; a separator connected to the intake of the pump adapted to remove solid particles from fluid drawn into the intake of the pump; and a particle purging apparatus comprising a particle receiving housing connected to the separator and having a passage therebetween through which particles can pass from the separator to the housing, means connected to the housing for supplying fluid under pressure thereto to agitate the particles into fluid suspension and to impart fluid pressure to the housing, a cylindrical vortex chamber extended longitudinally of the housing having a slot longitudinally therein communicating with the interior of the housing to receive fluid and fluid borne particles therefrom, said slot being disposed tangentially of the chamber to impart vortexing movement to fluid therein to sustain suspension of the particles, and exhaust means connected to the vortexing chamber to release fluid borne particles therefrom.

10. The combination of claim 9 having a flap valve providing a pressure plate and a sealing plate interconnected in fixed angular relation pivotally mounted in the housing for movement between a rest position to which it is gravitationally urged with the pressure plate positioned for impingement thereagainst of fluid from the supplying means and with the sealing plate spaced from the passage and an actuated position to which it is urged by impringement of fluid against the pressure plate with the sealing plate in closing relation to the passage.

11. A purging comprising a substantially fluid tight housing having an outlet and a passage adapted for connection to a source of fluid borne particles to receive the same therethrough, valve means for opening and closing said passage, and fluid means connected to the housing operative remotely from said housing alternately to close the valve means to pressurize the housing and force fluid borne particles from the housing through the outlet and to open the valve means to admit fluid borne particles through the passage.

12. The purging apparatus of claim 11 in which the fluid means delivers fluid under pressure to the housing to close the valve means and including fluid directing means integral with the valve means disposed when the valve means is in closed position to have fluid impinged thereagainst from the fluid means and to direct such fluid toward the outlet.

13. A purging apparatus comprising:

A. a substantially fluid tight housing having a passage adapted for connection to a source of fluid borne particles to receive the same therefrom, B. an inlet conduit connected to the housing, C. an outlet conduit connected to the housing, D. conntrolled means for supplying fluid under pressure to the inlet conduit for passage therethrough into the housing, E. valve means for opening and closing said passage, and F. fluid pressure responsive means operative alternately to open the valve so that the housing received particles from the source and to close the valve to pressurize the housing with influx of fluid from the inlet conduit to force fluid borne particles out the outlet conduit.

14. The apparatus of claim 13 in which the means for alternately opening and closing the valve means is responsive to influx of fluid from the inlet conduit to close the valve means and responsive to interruption of said influx to open the valve means.

15. The apparatus of claim 14 in which the inlet conduit jets fluid into the housing adjacent to the passage when fluid is supplied to said conduit, and the means for opening and closing the valve means includes weighted means integral with the valve means disposed in the jet of fluid to close the valve means when fluid is supplied to the inlet conduit and gravitationally to open the valve means when said jet is interrupted.

16. The apparatus of claim 14 in which the valve opening and closing means includes a formation disposed in said jet when the valve means is closed configurated to deflect the jet downwardly in the housing to agitate the fluid and fluid borne particles adjacent to the outlet conduit.

17. A purging apparatus comprising:

A. a substantially fluid tight housing adapted for connection to a source of fluid borne particles in downward extension therefrom, said housing having a wall between it and the source providing a passage therethrough for the gravitational descent of particles from the source into the housing;

B. an inlet conduit connected to the housing;

C. an outlet conduit connected to the housing;

D. controlled means for supplying fluid under pressure to the inlet conduit for passage therethrough into the housing; and E. valve means responsive to influx of fluid into the housing from the inlet conduit to close said passage to pressurize the housing and force fluid and fluid borne particles out the outlet conduit and responsive to interruption of said influx of fluid to open said passage to receive fluid and fluid borne particles from the source.

18. A purging apparatus comprising:

A. a particle collection housing having an upwardly disposed opening for the gravitational receipt of particles therethrough, B. a flap valve having a sealing surface and an oppositely disposed pressure receiving surface, C. means mounting the flap valve within the housing for pivotal movement toward the opening to bring the sealing surface into closing relation to the opening and away from the opening to a retracted position, D. inlet conduit means coonnected to the housing disposed to direct a fluid stream therethrough against the pressure receiving surface when the valve is in retracted position to urge the valve toward the opening and disposed to direct the fluid stream against the pressure receiving surface when the valve is closed to retain it in closed position, E. means for controlling fluid flow through the inlet conduit means, F. outlet conduit means connected to the housing and extended therefrom, and G. means on the valve positioned for the impingement of fluid thereagainst when the valve is in closed position to direct the fluid downwardly in the housing to agitate the particles therein for removal in fluid stream through the outlet conduit.

19. The purging apparatus of claim 18 including an elongated cylindrical tube mounted in an axially substantially erect attitude having a longitudinal slot opening in the housing tangentially to the tube whereby fluid bearing said particles enters the tube through the slot and is swirled therein to facilitate removal through the outlet conduit.

20. A purging apparatus comprising:

A. a particle collection housing adapted for connection to a source of fluid borne particles in downward extension therefrom;

B. a partition between the source and the housing having an opening therein for the descent of particles therethrough into the housing;

C. a flap valve having angularly related oppositely disposed sealing and pressure receiving surfaces;

D. means mounting the flap valve on the partition within the housing for pivotal movement toward the opening to dispose the sealing surface in closing relation thereto and from the opening to a retracted position;

E. inlet conduit means connected to the housing disposed to direct a fluid stream therethrough against the fluid receiving surface to urge the valve toward the opening;

F. means for controlling fluid flow through the inlet conduit means;

G. an elongated substantially cylindrical tube having a longitudinal slot open in the housing to receive fluid borne particles therefrom; and H. an outlet conduit connected to the tube, the pressure receiving surface of the valve being configurated to direct fluid impinged thereagainst when the valve is in closed position downwardly in the housing and toward the slot in the tube to facilitate removal of fluid borne particles therethrough, and the slot being substantially tangential to the tube to cause a vortex action therein to facilitate removal of fluid borne particles.

* * * * *

UNITED STATES PATENT AND TRADEMARK OFFICE

CERTIFICATE OF CORRECTION

PATENT NO. : 3,963,073

DATED : June 15, 1976

INVENTOR(S) : Claude C. Laval, Jr.

It is certified that error appears in the above-identified patent and that said Letters Patent are hereby corrected as shown below:

Column 1, line 24, delete "seperating" and substitute ---separating---.
Line 31, "seperator" should read -- separator --.

Line 42, between "from" and "areas" insert ---remote---.
Line 53, after "water" delete "of" and substitute ---or---.

Column 2, line 64, begin a new paragraph with "FIG. 8".

Column 3, line 46, between "valve" and "is" insert ---50---.
Line 61, delete "conduits" and substitute ---conduit---.
Line 68, delete "is" and substitute ---in---.

Column 4, line 1, delete "houusing" and substitute ---housing---.

Column 11, lines 50 and 51, delete "received" and substitute ---receives---.

Signed and Sealed this

Fifth Day of October 1976

[SEAL]

*Attest:*

RUTH C. MASON
*Attesting Officer*

C. MARSHALL DANN
*Commissioner of Patents and Trademarks*